US005667136A

United States Patent [19]

Chen

[11] Patent Number: 5,667,136

[45] Date of Patent: Sep. 16, 1997

[54] OBJECT COLLECTOR

[75] Inventor: Walter Chen, Annadale, Va.

[73] Assignees: Shirley Chen, Vienna, Va.; Therese Chen, Paris, France

[21] Appl. No.: 541,465

[22] Filed: Oct. 10, 1995

[51] Int. Cl.[6] ..... B65D 91/00

[52] U.S. Cl. ..... 232/43.2; 232/43.1; 220/23.4; 220/23.83; 220/909

[58] Field of Search ..... 232/47, 43.2, 50, 232/52, 1 R; 134/62; 220/23.4, 23.83, 909

[56] References Cited

U.S. PATENT DOCUMENTS

| | | | |
|---|---|---|---|
| 569,990 | 10/1896 | Arrick | 232/43.1 |
| 3,263,854 | 8/1966 | Powers | 232/43.1 X |
| 3,768,493 | 10/1973 | Kraeft | 134/62 X |
| 4,387,847 | 6/1983 | Downey | 232/43.2 |
| 5,137,212 | 8/1992 | Fiterman et al. | 232/43.2 |
| 5,425,458 | 6/1995 | Gilcreest et al. | 232/43.2 X |

*Primary Examiner*—Blair Johnson
*Attorney, Agent, or Firm*—David & Raymond; Raymond Y. Chan

[57] ABSTRACT

The present invention relates to an object collector for collecting objects in a plurality of containers, which comprises a tank body, an inlet device, a guiding device, a receiving device, and a collecting device. The tank body has a top inlet opening. The inlet device comprises a swinging plate which is pivotally and rotatably mounted, above the top inlet opening, to the upper portion of the tank body by means of a mounting device. The container and the objects thereon, which are placed on the swinging plate, may fall down from the swung down swinging plate due to the weight of the container and the objects. The guiding device comprises at least two guide rails which are mounted and extended from one side of the upper portion of the tank body toward the opposing side of the lower portion of the tank body for guiding the falling down container to slide down and toss over. The receiving device is positioned under the guiding device in the tank device for receiving the objects fallen from the container while it is tossing over along the guiding device. The collecting device is placed adjacent to the guiding device for receiving and collecting the container fallen from the guiding device.

13 Claims, 6 Drawing Sheets

OBJECT COLLECTOR

BACKGROUND OF THE PRESENT INVENTION

The present invention relates to a collector, and more particularly to an object collector which can guide an object container to toss automatically for throwing the objects therein into a receiving device and collecting the container with a collecting device.

Common trash tank of fast food restaurant comprises a tank body and a trash bag stand placed within the tank body for supporting an opened trash bag. The upper portion of a front side of the tank body has a rectangular opening, in which a swinging door is pivotally mounted thereto. Normally, the swinging door is vertically hanged and covers the opening.

The fast food restaurant serves their customers with the food and beverage on a tray. The trashes such as the containers of the food and beverage left on the tray by the customer can be collected by pushing the door of the trash tank inwardly and throwing the trashes on the tray into the trash bag of the trash tank through the opening. The trays are then required to place on the top surface of the trash tank.

However, the customer has to use one hand to push the swinging door of the trash tank in order to keep it open, and, at the same time, the customer has to use the other hand to hold the tray and to insert the tray into the trash tank through the opening for throwing the trashes thereon into the trash bag. People may have the similar experience that it is difficult to operate the aforesaid actions with two hands simultaneously to dear all the trashes on the tray. Moreover, to some disabled customers, it is impossible for them to operate the conventional trash tank with one hand only. Some of the trashes may easily drop to the ground or remain on the tray. It is because the trash tank does not has enough interior room above the trash bag for fully receiving the tray and tossing over the tray by hand. Besides, the uncleaned trays placed on the trash tank may affect the sanitation condition of the restaurant.

Occasionally, the customers may slip their hands and drop the trays into the trash bag that it constitutes the unexpected loss to the restaurant. Since the conventional trash tank requires skillful technique as mentioned above to operate, it is extremely difficult for some customers, such as the children and the handicapped or disabled people, to throw the trashes on the tray into the conventional trash tank.

SUMMARY OF THE PRESENT INVENTION

The main object of the present invention is to provide an object collector which utilizes the theory of gravity to enable the object, such as trashes, on an object container, such as a tray, to throw into a receiving device automatically. Wherein the tray is guided to toss over by means of a guiding device and the trashes thereon may fall into the receiving device due to gravity. Moreover, the empty tray is also guided to be received and collected by a collecting device simultaneously.

Another object of the present invention is to provide an object collector which enables the children and handicapped or disabled people to operate easily.

Accordingly, an object collector of the present invention comprises a tank body, an inlet device, a guiding device, a receiving device, and a collecting device.

The tank body has a top inlet opening, a front side wall, a back side wall, a right side wall, a left side wall, and a door installed to one of stud side walls.

The inlet device comprises a swinging plate made of fight material and a mounting device for pivotally mounting the swinging plate horizontally above the top inlet opening at the upper portion of the tank body. So that when a downward pushing force applies to the swinging plate, the swinging plate will swung downwardly to open the inlet opening of the tank body.

The guiding device comprises at least two guide rails installed within the tank body without obstructing the swinging path of the swinging plate, wherein the two guide rails are downwardly extended, below the swinging plate, from an upper portion of one side of the tank body toward a lower portion of the opposing side of the tank body. The distance between the two guide rails is narrower than the width of the containers. Moreover, the two upper ends of the two guide rafts being mounted beyond and adjacent to a down swinging edge of the swinging plate and the two lower ends of the two guide rails being extended and mounted under another opposing edge of the swinging plate with a predetermined vertical distance. Whereby the container and the objects thereon, which are sliding down from the swinging plate due to gravity while the swinging plate is swinging down due to the weight of the container and the objects, may fall down to the guiding device gradually. The two guide rails of the guiding device guide the falling of the container to slide toward their lower ends. When the container and the objects thereon leave the swinging plate, the swinging plate may swing up back to its normal horizontal position and push the falling container to toss over simultaneously, so that the objects in the container can be thrown down by means of the gravity.

The receiving device is positioned under the guiding device in the tank body for receiving all the objects fallen down from the container.

The collecting device is placed in a predetermined position adjacent to the lower ends of the two guide rails for receiving and collecting the containers fallen from the guiding device.

FIG., 2 is a partial sectional perspective view of the above first embodiment of an object collector according to the present invention.

Figure 3:
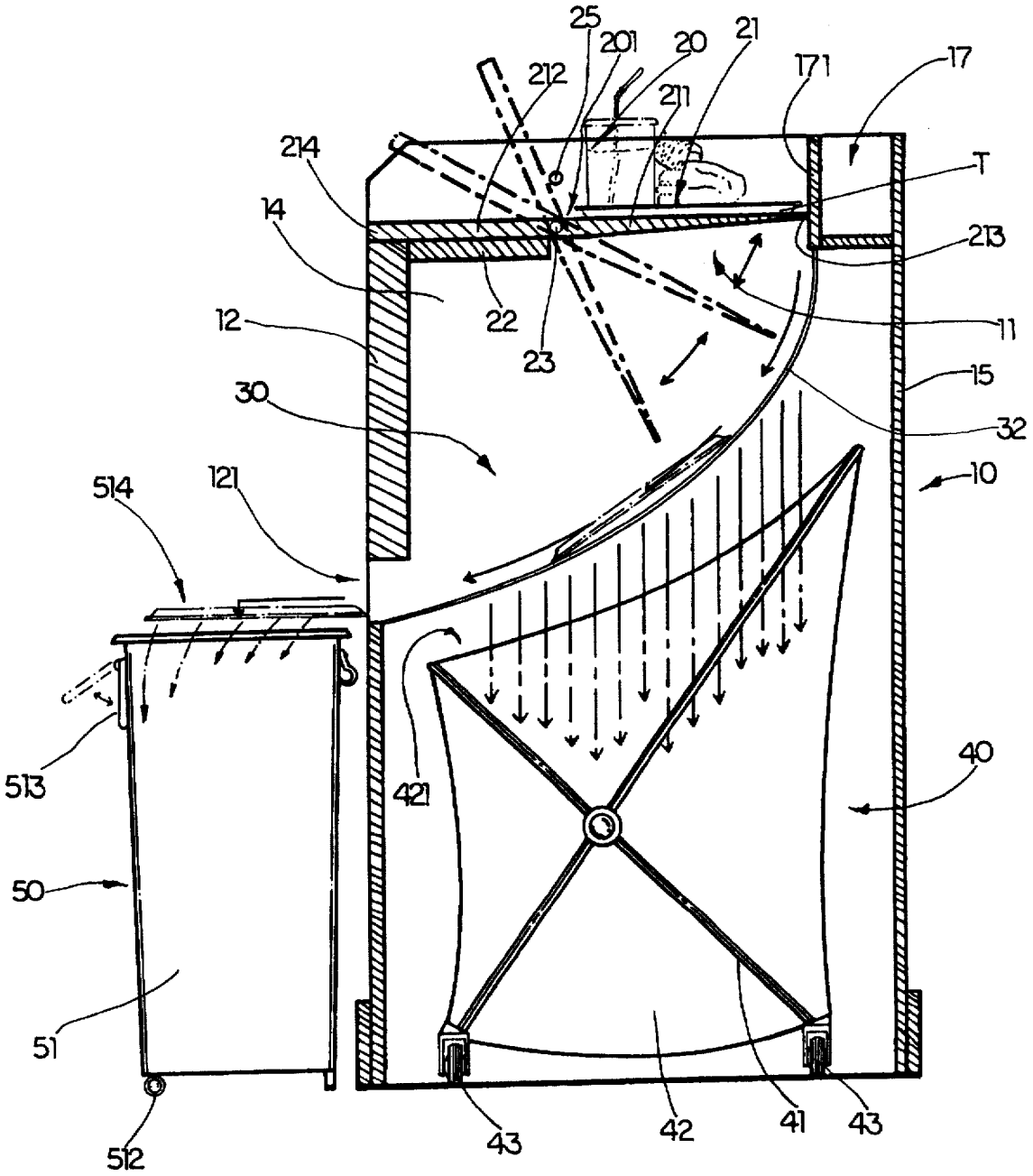

FIG. 3 is a sectional end view of the above first embodiment of an object collector according to the present invention.

Figure 4:
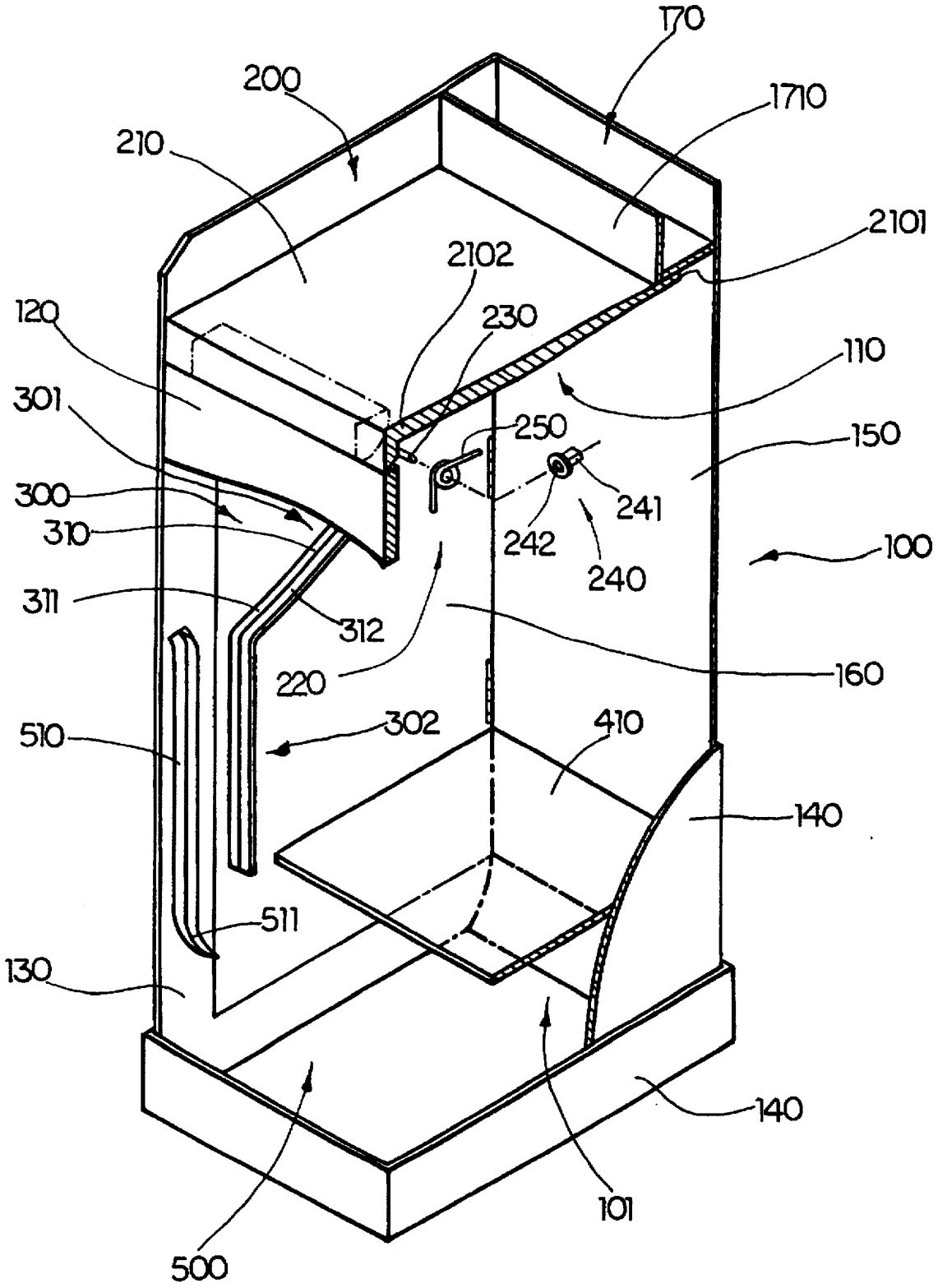

FIG. 4 is a partial sectional and partial exploded perspective view of a second embodiment of an object collector according to the present invention.

Figure 5:
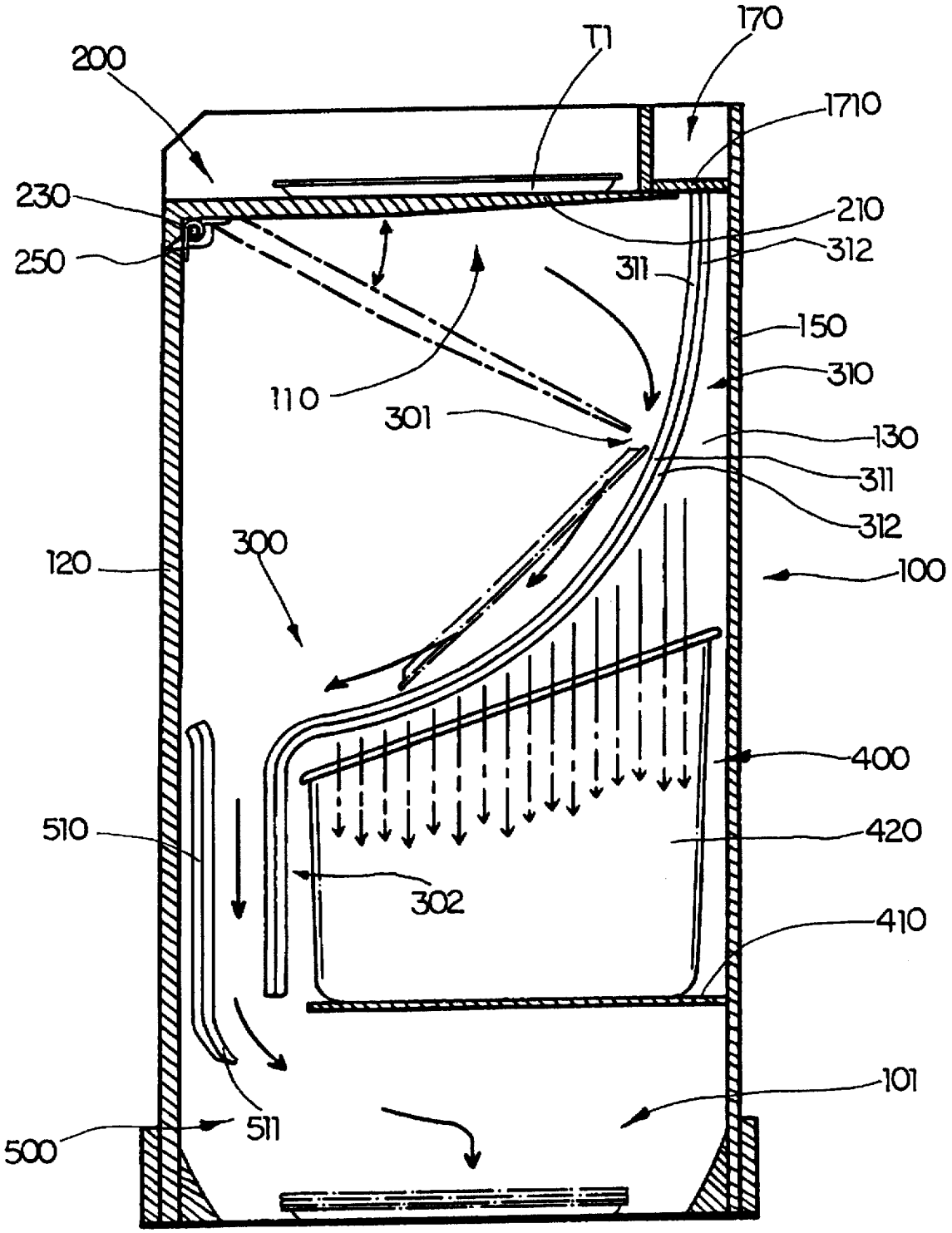

FIG. 5 is a sectional end view of the above second embodiment of an object collector according to the present invention.

Figure 6:
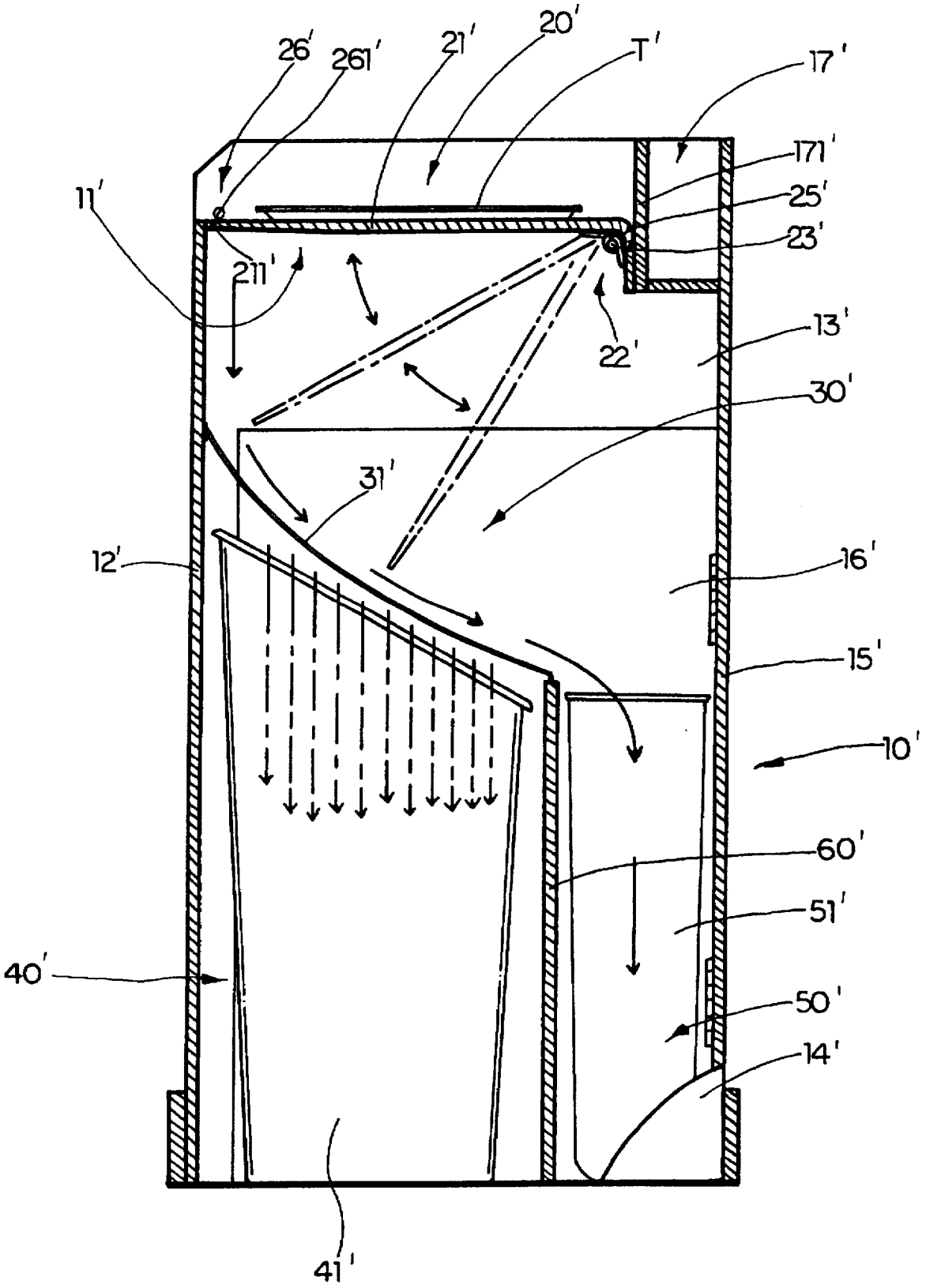

FIG. 6 is a sectional end view of a third embodiment of an object collector according to the present invention.

DETAILED DESCRIPTION OF THE PREFERRED EMBODIMENT

Figure 1:
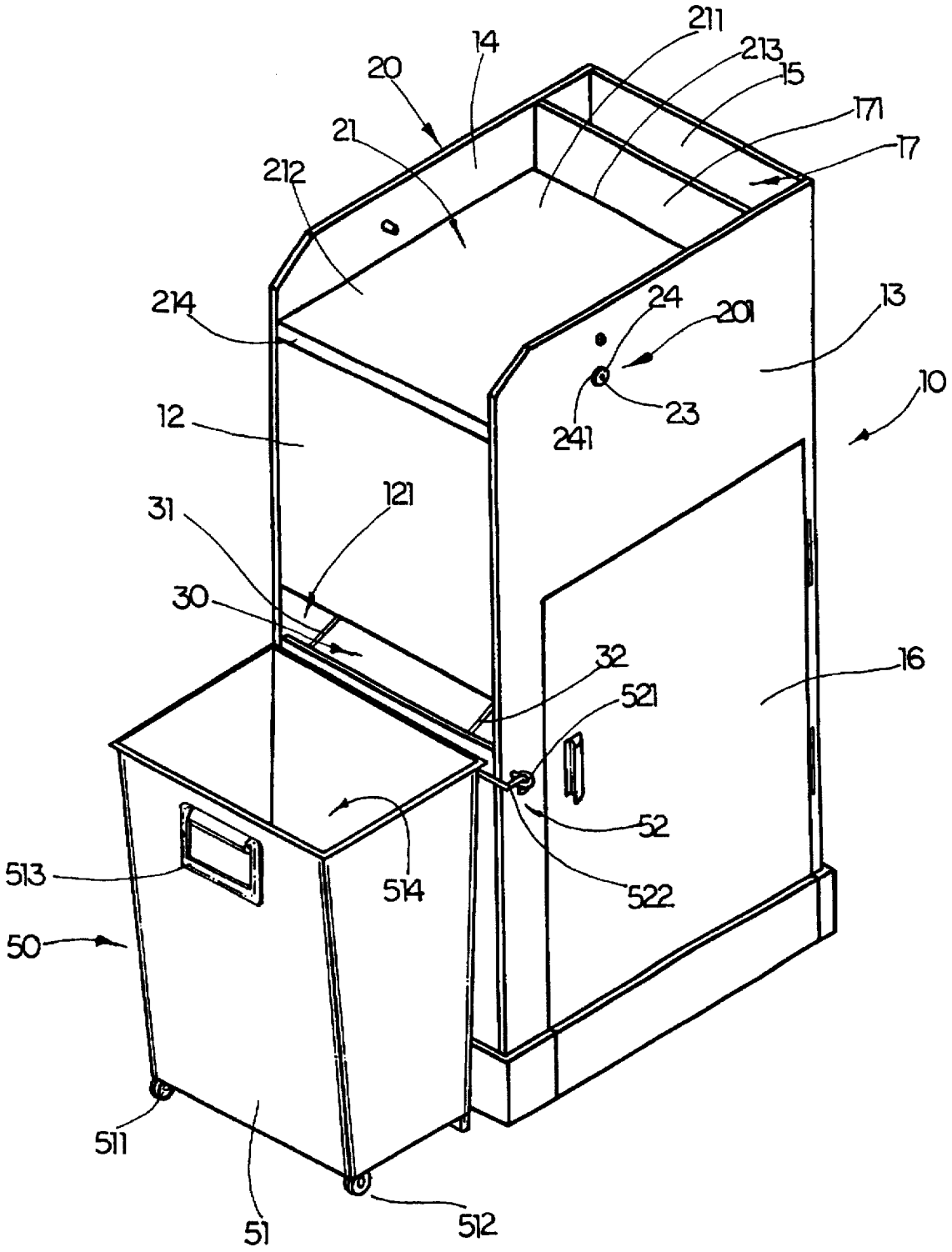
FIG. 1 is a perspective view of a preferred embodiment of an object collector according to the present invention.
Figure 2:
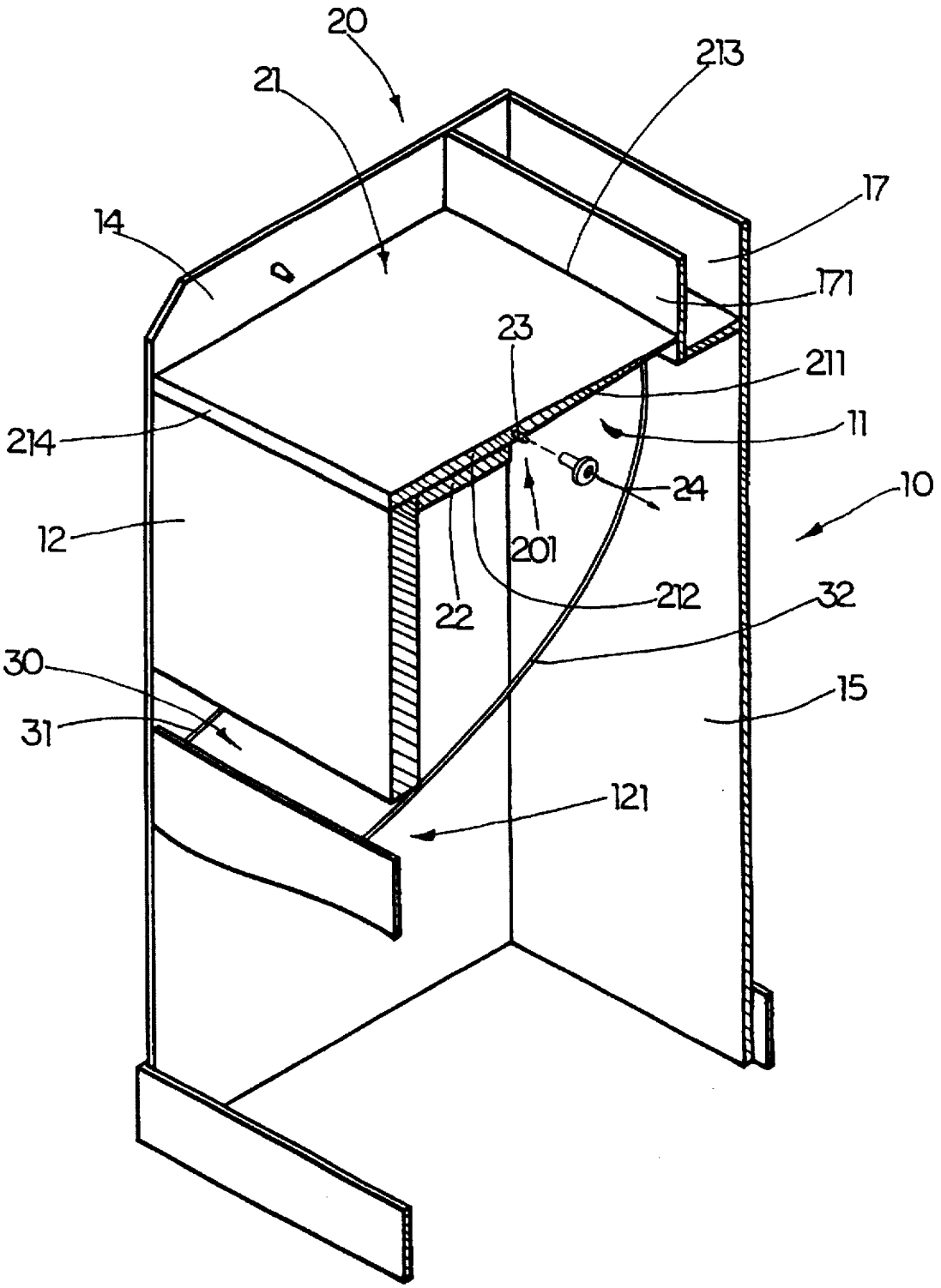

Referring to FIG. 1 to 3 of the drawings, a preferred embodiment of an object collector according to the present invention is illustrated. The object collector for collecting objects, such as trashes, in a plurality of containers, such as the trays used in a restaurant, comprises a tank body 10, an inlet device 20, a guiding device 30, a receiving device 40, and a collecting device 50. In accordance with the present embodiment, the object collector is specialized and designated to collect the trashes on the trays of a restaurant.

The tank body 10 is a hollow tank with a top inlet opening 11 and surrounding side walls 12, 13, 14, 15. The tank body 10 further installs a door 16 to the side wall 13 and provides a storage groove 17 by fixing a L-shape top board 171 to the top portion of the back side wall 15 for storing objects like sauce container, ash tray, or napkin container, etc.

The inlet device 20 comprises a swinging plate 21 which is pivotally mounted to the upper portion of the tank body 10, above the inlet opening 11, by means of a mounting device 201 in order to cover the inlet opening 11 horizontally. When a downward pushing force applies to the swinging plate, the swinging plate is swung downwardly to open the inlet opening 11 of the tank body 10. The inlet device 20 further comprises a supporting board 22 which is horizontally fixed to the top of the front side wall 12. Accordingly, the inlet opening 11 is the space defined between the L-shape top board 171, the supporting board 22, and the right and left side walls 13, 14.

According to this first preferred embodiment, the swinging plate 21 is composed of two halves, that is an entrance portion 211 and a weight portion 212. The entrance portion 211 has a length and a width equal to or larger than that of the trays, and has an average thickness thinner than the weight portion 212, which has a width equal to and a length smaller than that of the entrance portion 211. The weight of the entrance portion 211 is designed to be equal to the weight of the weight portion 212. The mounting device 201 includes two pivot pros 23 and two friction reducing receivers 24. The two pivot pros 23 are protruded on the right and left sides of the swinging plate 21 respectively, at the intersection positions of the entrance portion 211 and the weight portion 212. The swinging plate 21 is installed to the top portion of the tank body 10 by rotatably connecting the two pivot pros 23 with the two friction reducing receivers 24 which are firmly inserted into two receiving sockets 241 provided at the corresponding positions on the side walls 13, 14 respectively. The two friction reducing receivers 24 can be two socket caps or two bearings. So that the swinging plate 21 is able to rotate about the axis between the two pivot pros 23.

Since the entrance portion 211 and the weight portion 212 of the swinging plate 21 have the same weight, normally, the swinging plate 21 is horizontally mounted on the top portion of the tank body 10 with the weight portion 212 sitting on the supporting board 22 and covers the inlet opening 11. As shown in FIG. 3, the supporting board 22 supports the swinging plate 21 and the tray T until the tray T with trashes thereon is slid rearward on the swinging plate 21 from the weight portion 212 to the entrance portion 211, the weight of the tray T and trashes forms a downward force applied to the entrance portion 211 of the swinging plate 21. So that the total weight on the entrance portion 211 becomes heavier than the weight portion 212, and the swinging plate 21 begins to swing about the axis between the two pivot pins 23 due to gravity. Wherein the weight portion 212 is swinging upwardly and the entrance portion 211 is swinging downwardly to open the inlet opening 11. Simultaneously, the tray T and the trashes thereon fall into the tank body 10 via the inlet opening 11.

A stop means 25 is installed to the tank body 10 in a position located along the swinging path of the swinging plate 21 for preventing the swinging plate 21 from over swinging by stopping the swinging of the swinging plate 21. In accordance with this first preferred embodiment, the stop means 25 comprises at least a stopper protruded on the upper portion, vertically above the two receiving sockets 241, of the inner side of one of the side walls 13, 14. Thus, the weight portion 212 of the swinging plate 21 will be stopped by the stopper 25 when it is swinging up. At that time, the tray T and the trashes thereon are totally fallen into the tank body 10 (as the direction arrows shown in FIG. 3) and the swinging plate 21 may swing back due to the reaction force from the stopper 25 to its horizontal normal position.

The guiding device 30 comprises two parallel guide rails 31, 32 installed within the tank body 11 and without obstructing the swinging path of the swinging plate 21. The two parallel guide rails 31, 32 are downwardly extended from an upper portion of one side of the tank body 11 toward a lower portion of the opposing side of the tank body 11 below the swinging plate 21. The distance between the two parallel guide rails 31, 32 is narrower than the width of the tray T. The two upper ends of the two guide rails 31, 32 are mounted beyond and adjacent to the down swinging edge 213 of the swinging plate 21 and the two lower ends of the two guide rails 31, 32 are extended and mounted under another opposing edge 214 of the swinging plate 21 with a predetermined vertical distance. Therefore, the tray T and the trashes thereon, which are sliding down from the swinging plate 21 due to gravity, may fall down to the guiding device 30 gradually while the swinging plate 21 is swinging down due to the weight of the tray and the trashes. The two guide rails 31, 32 of the guiding device 30 guide the falling of the tray T to slide toward their lower ends. When the tray T and the trashes thereon leave the swinging plate 21, the swinging plate 21 will swing up back to its normal horizontal position and push the upper edge of the falling tray T rearwardly, as shown in FIG. 3. A torque force is then applied to the tray T and makes the tray T to toss over. The trashes on the tray T will be thrown down by means of the gravity.

In accordance with this first preferred embodiment, the two guide rails 31, 32 are two identical curve guiding wires. The upper ends of the two guiding wires 31, 32 are firmly fixed to the bottom side of the L-shape top board 171. The two guiding wires 31, 32 are extended downwardly and forwardly toward the front side wall 12 in order to form a curve bending shape respectively. The lower ends of the two guiding wires 31, 32 are firmly fixed to a middle position of the front side wall 12 which has a dispensing opening 121 provided just above the two lower ends of the two guiding wires 31, 32. The dispensing opening 121 has a width larger than the width of the tray T, so that the tossed over tray T which is guided to fall along the two guiding wires 31, 32 can exit the tank body 10 via the dispensing opening 121.

The receiving device 40, as shown in FIG. 3, is located under the guiding device 30 in the tank body 10 and comprises a supporting stand 41 and a receiving bag 42. The receiving bag 42 is a trash bag mounted on the supporting stand 41 with its opened bag mouth 421 right under the two guiding wires 31, 32 for receiving all the trashes fallen down from the tray T. The supporting stand 41 can be a trash can or an extensible wire made stand (as shown in FIG. 3) which has four wheels 43 mounted to its four bottom corners. When the receiving bag 42 is full of trashes, one can simply open the door 16, pull the stand 41 to roll out of the tank body 10 for replacing a new receiving bag 42, and then push the stand 41 back into the tank body 10.

The collecting device 50, as shown in FIG. 3, comprises a collecting tank 51 with an interior size slightly larger than the tray T for collecting the trays T fallen down from the guiding device 30. According to this first preferred embodiment, the collecting tank 51 has two rolling wheels 511, 512 spacedly mounted to its bottom, and a pushing handle 513 mounted to its upper portion. The collecting tank 51 is parked in front of the front side wall 12 and enables its top opening 514 adjacent to and just below the dispensing opening 121. So that the trays T sliding down from the guiding device 30 can exit the tank body 10 through the dispensing opening 121 and drop into the collecting tank 51 via its top opening 514. As shown in FIG. 1, the collecting device 50 further comprises a detachable locking means 52 for locking the collecting tank 51 to the tank body 10 so as to ensure the parking position of the collecting tank 51 and the tray collecting function. The locking means 52 includes two o-ring receivers 521 installed to the right and left side walls 13, 14 of the tank body 10 respectively and two C-shape inserters 522 mounted to the two sides of the collecting tank 51 respectively. Thus, the collecting tank 51 can be connected to the tank body 10 firmly by hooking the two C-shape inserters 522 to the two O-shape receivers 521.

Please referring to FIG. 4 and 5, a second preferred embodiment of an object collector according to the present invention is illustrated. The object collector is also specialized and designated to collect the trashes on a tray T1 of a restaurant and comprises a tank body 100, an inlet device 200, a guiding device 300, a receiving device 400, and a collecting device 500.

The tank body 100 is a hollow tank with a top inlet opining 110 and four surrounding side walls 120, 130, 140, 150. The tank body 100 has a door 160 installed to the left side wall 130 and provides a storage groove 170 by fixing a L-shape top board 1710 to the top portion of the back side wall 15 for storing objects like sauce container, ash tray, or napkin container, etc. such as the first embodiment described above. The inlet opening 110 is the space defined by the front side wall 120, the L-shape top board 1710 and the right and left side walls 130, 140.

The inlet device 200 comprises a light plastic swinging plate 210 which has a width slightly smaller and a length slightly larger than that of the inlet opening 110. The swinging plate 210 is pivotally mounted to the upper portion of the tank body 100, above the inlet opening 110, by means of a mounting device 220 in order to cover the inlet opening 110 horizontally. The mounting device 220 comprises two pivot pros 230, two identical friction reducing receivers 240 and two pull back springs 250. The two round pivot pros 230 are fixed to the two front ends of the right and left sides of the swinging plate 210 respectively. Each of the two identical friction reducing receivers 240 has a cap body 241 with an axial circular receiving hole 242. The outer shape of the cap body 241 is in polygonal shape. The two friction reducing receivers 240 are firmly inserted into two polygonal receiving sockets provided on the inner front side edges of the upper portions of the right side wall 130 and left side wall 140 respectively. The two pivot pros 230 are rotatably inserted into the two receiving holes 242 of the two friction reducing receivers 240 respectively. The two pull back springs 250 are mounted to the two pivot pros 230 respectively that each pull back spring 250 has one end extended horizontally so as to attach to the bottom side of the swinging plate 210. Another end of each pull back spring 250 extends vertically to attach to the inner side of the front side wall 120, as shown in FIG. 5. The length of the swinging plate 210 is longer than the length of the inlet opening 110, so that the front bottom edge of the top board 1710 can be act as a stop means for stopping the upward motion of the swinging plate 210 caused by the pull back springs 250. The two pull back springs 250 provide the swinging plate 210 an upward pulling force, which is equal or slightly larger than the weight of the swinging plate 210, so as to maintain the horizontal position of the swinging plate 210. The upward pulling force should be less than the total weight of the swinging plate 210 and the tray T1 used by the restaurant.

The guiding device 300 comprises two parallel guide rails 310 installed to the inner sides of the right and left side walls 130, 140 respectively without obstructing the swinging path of the swinging plate 210. Each of the two guide rails 310 has a L-shape cross section and comprises a vertical rim 311 and a horizontal guide rim 312. The two curved horizontal guide rims 312 are protruded perpendicularly from the inner sides of the right side wall 130 and the left side wall 140 respectively by securing the two vertical rims 311 to the inner sides of the right and left side walls 130, 140 respectively. The two guide rails 310 are extended downwardly from an upper portion near the back side wall 150 of the tank body 100 toward a lower portion near the front side wall 120 of the tank body 100 respectively. The distance between the two guide rails 310 is narrower than the width of the tray T1. Each of the two guide rails 310 has a curve portion 301 and a vertical portion 302. Besides, two upper ends of the two curve portions 301 of the two guide rails 310 are mounted beyond and adjacent to the down swinging edge 2101 of the swinging plate 210, and the two lower ends of the curve portions 301 of the two guide rails 310 are extended and mounted under the opposite fixing edge 2102 of the swinging plate 21 with a predetermined vertical distance. The two vertical portions 302 of the two guide rails 310 are extended vertically from the two lower ends of the two curve portions 301 to the bottom portion of the tank body 100 respectively, and that the two vertical portions 302 retain a horizontal distance, less than the thickness of the tray T1, to the front side wall 120.

As shown in FIG. 5, the receiving device 400 is located, under the guiding device 300, in a middle portion of the tank body 100 and comprises a supporting frame 410 and a receiving can 420. The supporting frame 410 is a dividing plate horizontally fixed to the bottom portion of the tank body 100. The receiving can 420 is placed on the supporting frame 410 in a position between the back side wall 150 and the vertical portions 302 of the two guide rails 310, 320.

The collecting device 500 comprises a pair of guiders 510 which are two rails vertically installed to the right and left edges of the inner side of the front side wall 120 respectively. Each of the two guiders 510 has a bottom curved end 511 extended downwardly and rearwardly to the bottom of the tank body 100. Between the bottom of the tank body 100 and the supporting frame 410 is a receiving chamber 101 for collecting the trays T1, as shown in FIG. 5.

According to the second preferred embodiment as described above, the swinging plate 210 is normally maintained in a horizontal position to cover the inlet opening 110 by means of the upward pulling force provided by the two pull back springs 250. As shown in FIG. 5, when a tray T1 with trashes thereon is sliding rearward on the swinging plate 210, the weight of the tray T1 and trashes forms a downward force applied to the swinging plate 210, which is larger than the upward pulling force. The weight of the tray T1 and trashes push the swinging plate 210 to swing downward in order to open the inlet opening 110. Thus, the tray T1 and the trashes thereon fall into the tank body 100 via the inlet opening 110. When the tray T1 and the trashes are totally fallen into the tank body 100, the swinging plate 210 may swing back to its horizontal normal position by means of the spring force of the two pull back springs 250. The swing back action of the swinging plate 210 can be stopped when a down swinging edge 2101 of the swinging plate 210 is stopped by the front bottom edge of the dividing board 1710.

The tray T1 and the trashes thereon, which are sliding down from the swinging plate 210 due to gravity, may fall down to the guiding device 300 while the swinging plate 210 is swinging down. The two side rims of the tray T1 may sit on the two guide rails 310 of the guiding device 300, so that the tray T1 can be guided to slide down along the two guide rails 310. At that time, the swinging plate 210 will swing up back to its horizontal position and push the upper edge of the falling tray T1 rearwardly. A torque force is then applied to the tray T1 to toss it over. The trashes on the tray T1 will then be thrown down to the receiving can 420 by means of gravity. Simultaneously, the empty tray T1 sliding down from the curve portions 301 of the two guide rails 310 is guided by the two guiders 510 to fall vertically to the bottom portion of the tank body 100 and is further guided by the curved ends 511 to fall to the receiving chamber 101.

Please referring to FIG. 6, a third preferred embodiment of an object collector according to the present invention is illustrated. The object collector of the third embodiment is also specialized and designated to collect the trashes on a tray of a restaurant and comprises a tank body 10', an inlet device 20', a guiding device 30' a receiving device 40', and a collecting device 50'.

The tank body 10' is a hollow tank with a top inlet opening 11' and four surrounding side walls 12', 13', 14', 15'. The tank body 10' further installs a door 16' to the side wall 13' and provides a storage groove 17' by fixing a L-shape top board 171' to the top portion of the back side wall 15' for storing objects like sauce container, ash tray, or napkin container, etc.

The inlet device 20' comprises a swinging plate 21' which is made of light plastic material and is pivotally mounted to the upper portion of the tank body 10', above the inlet opening 11', by means of a mounting device 22' in order to cover the inlet opening 11' horizontally. The mounting device 201' comprises two pivot pins 23 ', two friction reducing receivers 24' and two pull back springs 25'. The two round pivot pins 23' are rotatably connected, in front of the L-shape top board 171', with the inner sides of the upper rear portions of the right and left side walls 13' and 14' respectively. The two pull back springs 25' are mounted to the two pivot pins 23' respectively that each pull back spring 25' has one end extended horizontally so as to attach to the bottom side of the swinging plate 21'. Another end of each pull back spring 25' extends vertically to attach to the vertical front bottom edge of the L-shape top board 171'. The size of the swinging plate 21' should be larger than the size of the tray T', as shown in FIG. 6. The two pull back springs 25' provide the swinging plate 21' an upward pulling force, which is equal or slightly larger than the weight of the swinging plate 21', for pulling the swinging plate 21' upward to maintain in a horizontal position. Moreover, the upward pulling force should be less than the total weight of the swinging plate 21' and the tray T' used by the restaurant.

A stop means 26' is installed to the tank body 10' along the swinging path of the swinging plate 21' for preventing the swinging plate 21' from over swinging by stopping the upward swinging of the swinging plate 21' and retaining the swinging plate 21' in the horizontal normal position. According to the this third embodiment, the stop means 26' comprises two stop heads 261' protruded on the upper front portion of the right and left side walls 13', 14' respectively. So that a front down swinging edge 211' of the swinging plate 21' can be stopped by the stop heads 261' when the swinging plate 21' is swinging upward due to the upward pulling force provided by the two pull back strings 25'. Whereto the upward pulling force should be less than the weight of the tray T' used by the restaurant.

The guiding device 30' of this third embodiment is similar to the guiding device disclosed in the first embodiment that it comprises two parallel guide rails 31'. The two guide rails 31' are two identical curve guiding wires. The two upper rods of the two guiding wires 31' are firmly fixed to the front side wall 12' in an upper position under the down swinging edge 211' of the swinging plate 21'. The two guiding wires 31' are thin extended downwardly and rearwardly toward the back side wall 15' in order to form a curve bending shape respectively. The lower ends of the two guiding wires 31' extend to a middle position of the tank body 10' and then fix to a dividing wall 60' located between the receiving device 40' and the collecting device 50'.

The receiving device 40' is positioned, under the guiding device 30', in a lower portion of the tank body 10', and comprises a receiving can 41' for receiving the trashes fallen from the tray T' while it is sliding along the guiding device 30'.

The collecting device 50' comprises a collecting can 51' which is placed behind the receiving can 41'. The dividing wall 60' is installed vertically between the receiving can 41'for collecting the trays T' and the collecting can 51' in the tank body 10'.

In accordance with the third preferred embodiment as described above, the swinging plate 21' is normally maintained in a horizontal position to cover the inlet opening 11' by means of the upward pulling force provided by the two pull back springs 25'. When the tray T' with trashes thereon is placed on the swinging plate 21', the weight of the tray T' and the trashes forms a downward force, which is larger than the upward pulling force, applied to the swinging plate 21'. The weight of the tray T' and the trashes push the swinging plate 21' swinging downwardly and rearwardly. Thus, the tray T' and the trashes are totally fallen into the tank body 10' and the swinging plate 21' swings back upwardly to its horizontal normal position by means of the spring force of the two pull back springs 25'. This swing back action of the swinging plate 21' can be stopped by the stop heads 261'. The tray T' and the trashes thereon, which are sliding sown from the swinging plate 21' due to gravity, may fall down to the guiding device 30' while the swinging plate 21' is swinging down. At that time, the swinging back swinging plate 21' pushes the upper edge of the falling tray T' forwardly. A torque force is then applied to the tray T' to make it toss over, so that the trashes on the tray T' will be thrown down to the receiving can 41' by means of gravity. Simultaneously, the empty tray T' sliding down from the lower ends of the two guiding wires 31' is guided and fallen to the collecting can 51.

It is worth to mention that the three embodiments disclosed above are only the examples of one of the appliances of the present invention, specialized and designated to the appliance of collecting trashes on a tray of a restaurant. The present invention can also be applied to industry appliance for collecting the manufactures in a container.

I claim:

1. An object collector for collecting objects in a plurality of containers, comprising a tank body having a top inlet opening, a front side wall, a back side wall, a right side wall, a left side wall, and a door installed to one of said side walls;

an inlet device, which comprises a swinging plate made of light material and a mounting device for pivotally mounting said swinging plate horizontally above said top inlet opening at an upper portion of said tank body, so that once a downward pushing force is applied to said swinging plate, said swinging plate is swung downwardly to open said inlet opening of said tank body, in which said swinging plate is composed of an entrance portion and a weight portion, said mounting device including two pivot pins protruding on a right and a left side of said swinging plate respectively and at an intersection position of said entrance portion and said weight portion, so that said swinging plate is installed to the top portion of said tank body by rotatably connecting said two pivot pins with two receiving sockets provided at two corresponding positions on said two opposing side walls respectively, so as to enable said swinging plate rotating about an axis between said two pivot pins, wherein said entrance portion has a length and a width at least equal to a length and a width of the containers, and an average thickness thinner than said weight portion, so that the weight of said entrance portion is equal to the weight of said weight portion;

a guiding device, which comprises at least two guide rails installed within said tank body without obstructing the swinging path of said swinging plate, wherein said two guide rails are downwardly extended from an upper portion of one side of said tank body toward a lower portion of the opposing side of said tank body below said swinging plate, and that the distance between said two guide rails is narrower than the width of the containers, two upper ends of said two guide rails being mounted beyond and adjacent to a down swinging edge of said swinging plate and two lower ends of said two guide rails being extended and mounted under another opposing edge of said swinging plate with a predetermined vertical distance; whereby, the container and the objects thereon, which are sliding down from said swinging plate due to gravity, may fall down to said guiding device gradually while said swinging plate is swinging down due to the weight of the container and the objects, in which said two guide rails of said guiding device guide the falling of the container to slide toward the lower ends thereof, and that when the container and the objects thereon leave said swinging plate, said swinging plate may swing up back to a normal horizontal position thereof and push the failing container to toss over, so that the objects within the container throw down by means of the gravity;

a receiving device, which is positioned under said guiding device in said tank body for receiving all the objects fallen down from the container; and a collecting device, which is placed in a predetermined position adjacent to the lower ends of said two guide rails for receiving and collecting the containers fallen from said guiding device.

2. An object collector as recited in claim 1, in which said inlet device further comprises a supporting board which is horizontally fixed to the top of said front side wall for supporting said weight portion of said swinging plate when said swinging plate being in horizontal position to cover said top inlet opening.

3. An object collector as recited in claim 2, further comprising a stop means which is installed to said tank body in a position located along the swinging path of said swinging plate for preventing said swinging plate from over swinging by stopping the swinging of said swinging plate.

4. An object collector as recited in claim 3, in which said stop means comprises at least a stopper protruded, vertically above said two receiving sockets, on an upper portion of an inner side of one of said right and left side walls for stopping said weight portion of said swinging plate while said swinging plate is swinging up.

5. An object collector for collecting objects in a plurality of containers, comprising a tank body having a top inlet opening, a front side wall, a back side wall, a right side wall, a left side wall, and a door installed to one of said side walls;

an inlet device, which comprises a swinging plate made of light material and a mounting device for pivotally mounting said swinging plate horizontally above said top inlet opening at an upper portion of said tank body, so that once a downward pushing force is applied to said swinging plate, said swinging plate is swung downwardly to open said inlet opening of said tank body, in which said swinging plate is composed of an entrance portion and a weight portion, said mounting device including two pivot pins protruding on a right and a left side of said swinging plate respectively and at an intersection position of said entrance portion and said weight portion, so that said swinging plate is installed to the top portion of said tank body by rotatably connecting said two pivot pins with two receiving sockets provided at two corresponding positions on said two opposing side walls respectively, so as to enable said swinging plate rotating about an axis between said two pivot pins;

a guiding device, which comprises at least two guide rails installed within said tank body without obstructing the swinging path of said swinging plate, wherein said two guide rails are two guiding wires, two upper ends of said two guiding wires being firmly fixed to an upper portion of one side of said tank body and extended downwardly toward a lower portion of the opposing side of said tank body below said swinging plate, and that the distance between said two guide rails is narrower than the width of the containers, two upper ends of said two guide rails being mounted beyond and adjacent to a down swinging edge of said swinging plate and two lower ends of said two grade rails being extended and mounted under another opposing edge of said swinging plate with a predetermined vertical distance; whereby, the container and the objects thereon, which are sliding down from said swinging plate due to gravity, may fall down to said guiding device gradually while said swinging plate is swinging down due to the weight of the container and the objects, in which said two guide rails of said guiding device guide the falling of the container to slide toward the lower ends thereof, and that when the container and the objects thereon leave said swinging plate, said swinging plate may swing up back to a normal horizontal position thereof and push the falling container to toss over, so that the objects within the container throw down by means of the gravity;

a receiving device, which is positioned under said guiding device in said tank body for receiving all the objects fallen down from the container; and a collecting device, which is placed in a predetermined position adjacent to the lower ends of said two guide rails for receiving and collecting the containers fallen from said guiding device.

6. An object collector as recited in claim 5, in which said tank body further comprises a top board fixed to the top portion of said back side wall.

7. An object collector as recited in claim 6, in which said top board is a L-shape top board fixed to the top portion of said back side wall to form a storage groove.

8. An object collector as recited in claim 6, in which the two upper ends of said two guiding wires of said guiding device are firmly fixed to a bottom side of said top board, and are extended downwardly and forwardly toward said front side wall in order to form a curve bending shape respectively, wherein the lower ends of said two guiding wires are firmly fixed to a middle position of said front side wall which has a dispensing opening providing just above said two lower ends of said two guiding wires and having a width larger than the width of the container.

9. An object collector as recited in claim 8, in which said receiving device is positioned under said guiding device in said tank body and comprises a supporting stand and a receiving bag mounted on said supporting stand for receiving the objects fallen down from the containers.

10. An object collector as recited in claim 9, in which said supporting stand of said receiving device has a plurality of wheels mounted to its bottom corners.

11. An object collector as recited in claim 9, in which said collecting device comprises a collecting tank with an interior size larger than a length and a width of the containers, said collecting tank being parked adjacent to an outer side of said front side wall and just below said dispensing opening of said tank body for collecting the containers fallen down from said guiding device via said dispensing opening.

12. An object collector as recited in claim 11, in which said collecting device further comprises at least two rolling wheels spacedly mounted to a bottom of said collecting tank, a pushing handle mounted to an upper portion of said collecting tank, and a detachable locking means for locking said collecting tank to said tank body so as to ensure a parking position of said collecting tank.

13. An object collector as recited in claim 12, in which said locking means includes two O-ring receivers installed to said right and left side walls of said tank body respectively and two C-shape inserters mounted to the two sides of said collecting tank respectively, whereby said collecting tank is connected to said tank body firmly by hooking said two inserters to said two O-shape receivers respectively.

* * * * *